United States Patent [19]

Sugata et al.

[11] Patent Number: 4,892,800

[45] Date of Patent: Jan. 9, 1990

[54] PHOTOSENSITIVE MEMBER HAVING A PHOTOCONDUCTIVE LAYER COMPRISING A CARBONIC FILM FOR USE IN ELECTROPHOTOGRAPHY

[75] Inventors: Masao Sugata, Yokohama; Tatsuo Takeuchi, Kawasaki; Hiroshi Satomura, Hatogaya; Yoshihiro Oguchi, Yokohama; Akio Maruyama, Tokyo; Keishi Saito, Nabari; Tohru Den, Atsugi; Susumu Ito; Keiji Hirabayashi, both of Tokyo; Keiko Ikoma, Yokohama; Noriko Kurihara, Kawasaki; Kuniji Osabe, Tama, all of Japan

[73] Assignee: Canon Kabushiki Kaisha, Tokyo, Japan

[21] Appl. No.: 98,314

[22] Filed: Sep. 18, 1987

[30] Foreign Application Priority Data

| | | | |
|---|---|---|---|
| Sep. 24, 1986 | [JP] | Japan | 61-225218 |
| Sep. 26, 1986 | [JP] | Japan | 61-227304 |
| Sep. 26, 1986 | [JP] | Japan | 61-227305 |
| Sep. 26, 1986 | [JP] | Japan | 61-227306 |

[51] Int. Cl.[4] ..... G03G 5/082

[52] U.S. Cl. ..... 430/85; 430/95

[58] Field of Search ..... 430/84, 85, 86, 95

[56] References Cited

U.S. PATENT DOCUMENTS

| | | | |
|---|---|---|---|
| 4,634,648 | 1/1987 | Jansen et al. | 430/84 |
| 4,673,589 | 1/1987 | Standley | 430/84 |
| 4,675,265 | 6/1987 | Kazama et al. | 430/67 |

*Primary Examiner*—J. David Welsh

*Attorney, Agent, or Firm*—Fitzpatrick, Cella, Harper & Scinto

[57] ABSTRACT

An improved photosensitive member for use in electrophotography which is characterized by having a substrate and a photoconductive layer comprising a carbonic film, the nucleus of which matrix being carbon atom, which contains 30 atomic % or less of hydrogen atom and at least one selected from the elements of Group III and Group V of the Periodic Table, and which has an optical band gap of more than 1.5 eV and an electrical conductivity of $10^{-11}\Omega^{-1}cm^{-1}$ or less.

It is always and substantially stable regardless of the changes in use environments and it enables to make highly resolved images with a clear half-tone which are highly dense and quality at high speed.

8 Claims, 5 Drawing Sheets

PHOTOSENSITIVE MEMBER HAVING A PHOTOCONDUCTIVE LAYER COMPRISING A CARBONIC FILM FOR USE IN ELECTROPHOTOGRAPHY

FIELD OF THE INVENTION

This invention relates to an improved photosensitive member for use in electrophotography (hereinafter, the term "photosensitive member for use in electrophotography" being referred to as the term "electrophotographic photosensitive member"). More particularly, it relates to an improved electrophotographic photosensitive member having a photoconductive layer comprising a carbonic film and which is substantially stable regardless of the changes in environmental use and which enables one to make a highly resolved image with a clear half-tone at high speed.

In this invention, the term "carbonic film" means such a film that is composed of a carbonic structural material containing 65 atomic % or more of carbon atoms and the nucleus of which matrix being carbon atom. Unless otherwise defined, the term "standard condition" means the atmospheric condition comprising atmospheric pressure, 20° C. for temperature and 50% for humidity.

BACKGROUND OF THE INVENTION

There have been proposed a number of electrophotographic photosensitive members having a photoconductive layer composed of an inorganic material such as amorphous selenium (A-Se), CdS, ZnO and amorphous silicon (A-Si) or an organic material.

However, for any of the known electrophotographic photosensitive members, there are still unresolved problems.

For instance, as for the known electrophotographic photosensitive member having a A-Se photoconductive layer, there is a limit for its use because its spectral sensitivity inclines toward the short wavelength side of visible region. In order to solve this problem, there is a proposal of incorporating Te or As into said A-Se photoconductive layer. For those electrophotographic photosensitive members having such A-Se series photoconductive layer containing Te or As, there can be recognized an improvement in the foregoing problem relating to the spectral sensitivity. However, they are still accompanied with various problems such as increase of a light fatigue, reduction of a charge-retentivity under a high temperature atmospheric condition, increase of a residual potential under a low temperature atmospheric condition, etc. which result in deterioration of the quality of the resulting image and also lack of the stability upon repeated use. Other than these, they have been accompanied by other problems in that the hardness of any of the foregoing photoconductive layers is relatively low, and because of this, especially in the case where the surface of said layer is not protected, when it is engaged repeatedly in the cleaning process in a high speed electrophotographic copying machine having an improved blade cleaning system, its surface becomes easily worn away producing fine particles which eventually intermix in developers, disperse in the copying machine, or otherwise, intermix in the resulting image.

Further in addition, for the foregoing electrophotographic photosensitive member, there is a further problem that because of a low crystallization temperature for selenium (Se), it will be easily crystallized with an incidental heat or with a light energy caused by light irradiation, and in that case, the charge-retentivity becomes reduced accordingly.

There are unresolved problems also for the known electrophotographic photosensitive members having a photoconductive layer composed of ZnO or CdS.

That is, in case of the electrophotographic photosensitive member having a photoconductive layer composed of ZnO, it is necessary to add an appropriate organic pigment in order for said layer to have a sufficient sensitivity against visible light. In addition to this, it is accompanied by a problem in that the photosensitivity is gradually decreased as it is used repeatedly and because of this, it is not suited for repeated use for a long period of time.

And, in case of the electrophotographic photosensitivity member having a photoconductive layer composed of CdS, there is a serious problem since CdS is harmful for a man. Therefore, not only extra attention but also provision of a specific means are necessary to be made in order to prevent occurrence of any environmental problems because of CdS not only in its production but also upon its use.

Now, for the known electrophotographic photosensitive members having a binder series photoconductive layer, there are also unresolved problems. That is, because of the specific requirement that photoconductive particles must be evenly dispersed in a resin binder, there exist a number of parameters to determine electric characteristics, photoconductive characteristics, and physical and chemical characteristics for a photoconductive layer to be prepared. And unless the related parameters are strictly coordinated, an objective desired photoconductive layer is hardly obtained. In addition, because of the uniqueness that the binder series photoconductive layer is a dispersion system and because of this, the layer is entirely of a porous structure, it is very sensitive against changes in the environmental humidity. And in the case where the electrophotographic photosensitive member having such photoconductive layer is used under highly humid environmental atmosphere, there will be easily produced a deterioration in the electric characteristics to thereby make it impossible to obtain a high quality image.

Also in case of other kinds of the known electrophotographic photosensitive members having a photoconductive layer composed of an organic photoconductive material, there still exist various unresolved problems in that the characteristics will be deteriorated during repeated use because of low corona discharging resistance, the cleaning properties are problematic for the reason that an organic polymer as well as toner is used, the surface is easily damaged because of weak mechanical strength and it is difficult to maintain the quality of an image obtained upon repeating use for a long period of time.

Further, for any known electrophotographic photosensitive member as mentioned above, there is another problem caused by occurrence of a friction between a cleaning blade and the photosensitive member which often invites undesirable effects not only in the cleaning properties but also in the electrophotographic properties, especially in case of using it in a high speed electrophotographic copying machine. For instance, it will become difficult to add a sufficient quantity of pressure between the cleaning blade and the photosensitive member in the case where the related coefficient of kinetic friction is large as much as to likely bring about undesirable influences especially on the electrophotographic characteristics.

SUMMARY OF THE INVENTION

This invention is aimed at eliminating the foregoing problems which are found on the conventional electrophotographic photosensitive members and providing an improved electrophotographic photosensitive member which stably and effectively exhibits the functions required for an electrophotographic photosensitive member without accompaniment of the foregoing problems.

It is therefore an object of this invention to provide an improved electrophotographic photosensitive member which is always and substantially stable regardless of the changes in use environments such as changes in environmental temperature and moisture and which enables to make highly resolved visible images with a clear half-tone which are highly dense and quality at high speed.

Another object of this invention is to provide an improved electrophotographic photosensitive member which excels in both mechanical strength and heat stability.

A further object of this invention is to provide an improved electrophotographic photosensitive member having an excellent surface lubricity and which is free not only from being mechanically scratched but also from being deposited with foreign matters such as fine particles resulting from corona discharge and other powdery materials resulting from papers to be fed, and which enables one to constantly make stable and satisfactory images even upon repeated use for a long period of time.

A further object of this invention is to provide an improved electrophotographic photosensitive member having a high charge-retentivity and a high photosensitivity which enables one to make satisfactory images even with a small quantity of a charging current and a small quantity of exposure energy.

A further object of this invention is to provide an improved electrophotographic photosensitive member having a specific carbonic photoconductive layer of reduced trap level in which a thermal carrier is barely generated and which is free from any changes in quality such as chemical change, deterioration, crystallization and the like even in the case where it is stored under poor environmental conditions for a long period of time.

A further object of this invention is to provide an improved electrophotographic photosensitive member which is desirably suited for high-speed electrophotographic copying system in which it can be smoothly and effectively cleaned without being damaged while maintaining its original image-making function even upon repeated use under poor conditions for a long period of time.

A further object of this invention is to provide an improved electrophotographic photosensitive member which is harmless for man even upon touching with and which causes less problems for public pollution even in the case where it is dumped together with daily refuse after use.

A further object of this invention is to provide an inexpensive improved electrophotographic photosensitive member which can be produced using easily obtainable harmless materials as the main raw materials in a simplified apparatus without being provided with a specific means to exhaust harmful materials.

DESCRIPTION OF THE INVENTION

Figure 1:
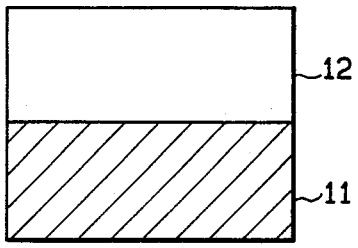
FIG. 1 is a schematic cross-sectional view illustrating a representative embodiment of an electrophotographic photosensitive member according to this invention.

The present inventors have made earnest studies for eliminating the foregoing problems of the conventional electrophotographic photosensitive members and attaining the objects as described above and as a result, have complished this invention.

A representative embodiment of an improved electrophotographic photosensitive member according to this invention comprises a substrate and a photoconductive layer constituted with a carbonic film, the nucleus of the material matrix is carbon atoms.

The carbonic film to be used in this invention has largely different characteristics from any of the hydrocarbon series highly insulative straight chain organic polymers such as polyethylene and also from the low-resistant graphite polycrystal films such as vacuum deposited films of black lead. The foregoing objects of this invention cannot be attained by using these known carbon films.

The reason is that organic polymer containing a large amount of hydrogen atom such as polyethylene can promote the charging efficiency but can barely obtain a desired sensitivity against visible region light and near-infrared region light in order to establish an electrophotographic photosensitive member. A practically usable electrophotographic photosensitive member cannot be obtained by using the above mentioned graphite polycrystal film because of its considerably low charge-retentivity.

The carbonic film of which main constituent being carbon atom to be used in this invention may be such that has a polycrystalline phase, an amorphous phase, a phase containing these two structure in a mixed state or other phase selected from those phases containing a single crystalline structure in one of the foregoing phases.

In a preferred embodiment, it is desired to be such that the ratio $\sigma p/\sigma d$ of an electric conductivity at exposure ($\sigma p$) to an electric conductivity at non-exposure (dark atmosphere) ($\sigma d$) is a value exceeding $10^2$ and the latter electric conductivity ($\sigma d$) is $10^{-11}\Omega^{-1}cm^{-1}$ or less.

In a further preferred embodiment especially in the case where said carbonic film is employed in an electrophotographic photosensitive member, it is desired to be such that in addition to the above conditions, the thickness of said carbonic film constituting the photoconductive layer is less than the product of the mobility and the lifetime of a carrier generated by light irradiation and the internal field intensity.

In a till further preferred embodiment, it is desired to be such that has, in addition to these conditions, such physical properties, chemical composition and crystalline structure as will be below described.

In this respect, the carbonic film to be employed in this invention is such that has a high insulating property under dark atmospheric condition, that the electric conductivity is remarkably increased upon exposure using a light source such as xenon lamp, etc. and that an electric charge generated upon the exposure is effectively transported by the electric field.

This situation is fully supported by the facts that will be below described, and because of this, the electrophotographic photosensitive member having a photoconductive layer constituted with such carbonic film according to this invention has a wealth of many practically applicable characteristics and it is well suited for high-speed repeating use.

By the way, hitherto, there have been various proposals about the use of a layer containing carbon atom as a constituent layer of an electrophotographic photosensitive member as disclosed in Japanese Unxamined Patent Publications Nos. 54(1979)-55439, 55(1980)-4040 (corresponding to U.S. Pat. No. 4,289,822), 56(1981)-121041, 60(1985)-26345, 61(1986)-94048, 61(1986)-94049 and 61(1986)-105551.

However, these publications concern an improvement in the film characteristics of a silicon containing amorphous film or a germanium containing amorphous film by adding carbon atom thereto while maintaining its original functions but do not have any concern over the utilization of functions derived from the nucleus of the matrix for a film to be carbon atom.

In fact, the carbonic film in this invention does contain neither silicon atom nor germanium atom, or even in the case where such atom is contained, its amount is of a relatively reduced one.

Further, the film forming conditions disclosed in the above-mentioned publications are directed for the formation of the foregoing silicon containing amorphous film or germanium containing amorphous film, under which conditions the carbonic film in this invention cannot be prepared.

The carbonic film in this invention can be properly prepared by decomposing, exciting or/and ionizing a gaseous mixture containing a carbon compound and hydrogen ($H_2$) under predetermined specific conditions as mentioned in examples of this invention which have been developed for the first time by the present inventors.

The mechanism of forming the carbonic film in this invention is yet clarified. However, it can be considered in the following way for the time being that imparting an energy to a raw material gaseous molecule by exposing a raw material gas to discharge or by heating said raw material gas, subjecting a substrate to the action of an accelating electron during film forming process, accelating an ion generated during the film forming process with an electric field, impressing a magnetic field to a plasma generation region of a film forming space, etc. would lead to forming a desired carbonic film to be the above carbonic film in this invention.

For the carbonic film in this invention, it is not desirable to contain a large amount of hydrogen atom, and the amount for hydrogen atom to be contained therein is 30 atomic % for the upper limit amount, and preferably, 20 atomic % or less.

That is, an excessive amount of hydrogen atom invites problems such as decrease in photosensitivity, increase in residual potential, easiness of being damaged for the surface, etc.

As for the lower limit for the amount of hydrogen atom to be structurally contained in the carbonic film, it is not particularly limited, but in the view points of desirably increasing a charge-retentivity and decreasing a residual potential, it is preferred to be 0.01 atomic %.

The incorporation of halogen atom such as fluorine atom into the carbonic film is also effective for obtaining the above effects as well as the case where hydrogen atom is incorporated thereinto.

In the latter case, it is, of course, possible to incorporate only such halogen atom, and it is preferred to incorporate such halogen atom together with hydrogen atom.

In addition, for the carbonic film in this invention, it may contain also nitrogen atom or oxygen atom in order to enhance the charge-retentivity that is, in the case where one or more selected from halogen atom, nitrogen atom and oxygen atom are incorporated in the way that such atom is contained largely in a layer region adjacent to the surface of the photoconductive layer comprising the foregoing carbonic film of the electrophotographic photosensitive member or in another layer region of said layer which is adjacent to the substrate, an expected result can be obtained.

As for the electric conductivity under dark atmospheric condition ($\sigma d$) of the carbonic film in this invention, in the case where it is too large, problems such as decrease in the charge-retentivity, occurrence of an unfocused image, etc. will be often brought about. In this respect, it is desired for the carbonic film to be such that has $10^{-11}\Omega^{-1}cm^{-1}$ or less of the $\sigma d$. In addition to this, it is also desired for the carbonic film to be such that the ratio $\sigma p/\sigma d$ of the above $\sigma d$ and the electric conductivity (photoconductivity) ($\sigma p$) when irradiated with a light exposure of less than 5 lux.sec. for the wavelength light near the maximum sensitivity of the photoconductive layer is a value of more than $10^2$, for the reason that when the ratio $\sigma p/\sigma d$ is less than a value of $10^2$, there will be often brought about problems such as occurrence of an increase in exposure energy, decrease in removing ability of a charge on the surface of the photoconductive layer to be surved for exposure and as a result, it becomes poor for tone reproduction.

Now, the carbonic film in this invention may be amorphous or other that partially contains a crystalline structure. However, it is desired to be such that has a structure characterized by Raman spectra in the region of 1550 to 1650 $cm^{-1}$ and in the region of 1333 $cm^{-1}$. In this case, the heat stability, photosensitivity, mechanical strength and charge-retentivity are desirably improved.

Further, for the carbonic film to constitute the photoconductive layer of the electrophotographic photosensitive member according to this invention, it is desired to have an optical band gap (Egopt) in the range from 1.5 eV to 3.0 eV in view of effectively promoting the generation of a carrier by the absorption of light in the photoconductive layer.

This adjustment of the optical band gap of the carbonic film to the above range can be made by properly controlling the concentration of hydrogen atom or/and halogen atom to be contained, the concentration of other kind of atom to be contained, the film forming conditions etc. depending upon the requirements therefor.

It is a matter of course that the aforesaid adjustment of a band gap for the carbonic film can be made also by properly increasing the flow ratio of a raw material gas imparting hydrogen atom or/and halogen atom to be introduced into a deposition chamber.

For the carbonic film in this invention, its characteristics can be desirably improved by doping it with an transition element. Especially, in the case where it is doped with a group III element or a group V element of the Periodic Table, its film characteristics are remarkably improved.

That is, for example, in the case where such dopant is incorporated in the photoconductive layer comprising the carbonic film in the way that its concentration be distributed in the thicknesswise direction, the generation of a carrier and its transportation in the photoconductive layer becomes more effectively conducted.

And, it is, of course, possible to control the photoconductive layer to have a desired conduction type by doping the layer with a dopant selected from the above mentioned elements.

In addition, the doping using one of the above mentioned elements of group III of group V makes it possible to use the electrophotographic photosensitive member according to this invention under positive polarity charge, negative polarity charge or ambipolarity charge, and serves to increase the charge-retentivity, to heighten the photosensitivity and to reduce a residual potential. This is considered due to that the concentration of a charge carrier in the photoconductive layer comprising the carbonic film would be changed by incorporating such dopant into the photoconductive layer or the transporting property for said carrier would be changed because of doping the photoconductive layer with such dopant.

As for the concentration of a dopant of either group III or group V [hereinafter referred to as "dopant (III,V)"] in the photoconductive layer comprising the carbonic film according to this invention, when a region containing a dopant (III,V) in a high concentration [hereinafter referred to as "dopant(III,V) high concentration region"] is provided with a lower layer region, an upper layer region or both the two layer regions by incorporating a dopant(III,V) into the photoconductive layer in the way that the layer region adjacent to the substrate or/and the layer region adjacent to its surface contains a dopant (III,V) in a high concentration, both the charge-retentivity and the photosensitivity may be effectively improved. And, in the case where the dopand(III,V) high concentration region is provided with the above mentioned two layer regions respectively, it is desired to make them to have a different conduction type each other.

For the amount of the dopant(III,V) to be contained in the photoconductive layer in the above case, it is preferably 5 atomic ppm to 5 atomic %, and more preferably, 50 atomic ppm to 1 atomic %.

And for the thickness of the dopant (III,V) high concentration region in any of the above cases, it is preferably 0.01 to 10 μm and more preferably, 0.1 to 8 μm. The details in this respect will be described in Examples of this invention.

Usable as the dopant of group III are B, Al, Ga, In, Tl, etc. And as the dopant of group V, there can be mentioned N, P, As, Sb, Bi, etc. Among these dopants, B, P and N are particularly preferred.

The upper limit for the thickness of the photoconductive layer comprising the carbonic film of the electrophotographic photosensitive member according to this invention is, as above described, desired to be less than the product of the mobility and the lifetime of a carrier generated by light irradiation and the internal field density mainly for the reason that the residual potential is to be prevented from being increased. On the other hand, as for its lower limit, when it is excessively thin, there will be sometimes invited such a problem that the internal field becomes unexpectedly greater and as a result, a dielectric breakdown occurs.

Therefore, the thickness of the photoconductive layer of the electrophotographic photosensitive member according to this invention is preferably 1 μm to 100 μm, and most preferably, 5 μm to 50 μm in view of the above and also in view of commercial viewpoints.

In the case where halogen atom is incorporated into the carbonic film constituting the photoconductive layer of the electrophotographic photosensitive member according to this invention, controlling the concentration of said halogen atom in the carbonic film from 10 atomic ppm to 15 atomic % brings about a desirable effect as below described.

That is, it is a common knowledge that the conducting state of an electric charge in an electrophotographic photosensitive member depends largely upon the conditions to be employed for the formation of its light receiving layer and because of this, such film forming conditions that enable formation of a desired light receiving layer causing a fine band conduction are limited to certain extents. And, even for such electrophotographic photosensitive member obtained under selected film forming conditions, there will be often found atrasient current waveform which is very much resembling to a dispersion pattern. This situation exists also in the electrophotographic photosensitive member according to this invention. However, the electrophotographic photosensitive member becomes free from such problem and does immobilized as a practically applicable electrophotographic photosensitive member by incorporating halogen atom into the carbonic film constituting the photoconductive layer in an amount of the foregoing range.

Such carbonic film containing halogen atom in this invention can be properly formed by means of vacuum vapor deposition under such specific conditions as above mentioned and as detailed in Examples of this invention which allow the formation of a desired carbonic film having the foregoing properties and characteristics.

Further, in order to further improve the cleaning properties of the electrophotographic photosensitive member according to this invention, its photoconductive layer is desired to be such that has a coefficient of kinetic friction between the carbonic films under standard condition which lies in the range of less than 0.5.

In this case, in addition to that the electrophotographic photosensitive member becomes accompanied with further improved cleaning properties, an electric charge injected into the photoconductive layer becomes effectively transported though the layer is of a high resistivity.

Here, reference is made to the measuring method of the foregoing coefficient of kinetic friction.

In the measurement the coefficient of kinetic friction for the carbonic film, it is essential to previously determine the measuring atmospheric conditions since it is difficult for the value to be stably obtained under usual atmospheric conditions and it will be easily varied depending upon the temperature, humidity, etc. under which the measurement is carried out to cause a difference of 2 to 3 folds or sometimes, of about 10 folds on a value obtained.

In this respect, the coefficient of kinetic friction for the carbonic film to constitute the photoconductive layer of the electrophotographic photosensitive member according to this invention is determined in accordance with the following equation:

$$\mu = F/P \qquad (1)$$

wherein $\mu$ means a coefficient of kinetic friction, F does a power to be applied and P does a vertical load.

Using the equation (1), even though the subject to be measured is of a cylindrical form such as a drum, the coefficient of kinetic friction therefor can be easily measured.

Now, a coefficient of kinetic friction between an electrophotographic photosensitive member and a cleaning blade is an important factor to be considered in the cleaning process of the photosensitive member. And, in the above consideration, there exist other factors to be included which are related to toner being present at that time and its amount, the constituent material of the cleaning blade, etc.

In this connection, the coefficient of kinetic friction in this specification is expressed by that between the surfaces of the electrophotographic photosensitive members for the reasons that there have been found the facts that there is a satisfactory interrelation between it and the cleaning properties and that it is practically meaningful.

Figure 5A:
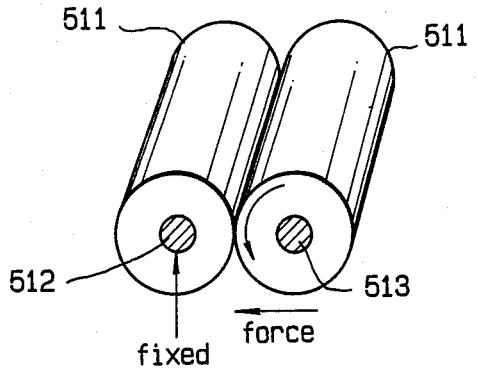
FIGS. 5(A) and 5(B) are schematic explanatory views of a method for measuring a coefficient of kinetic friction.
Figure 5B:
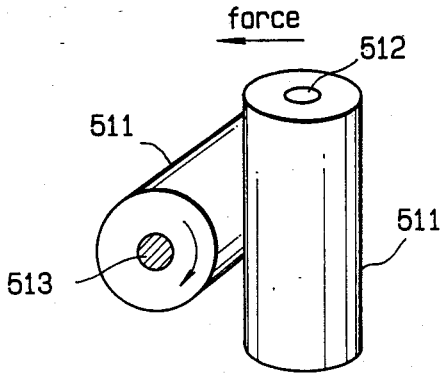

Explanation will be made about the method of measuring the coefficient of kinetic friction while referring to FIGS. 5(A) and 5(B).

Two photosensitive drum members 511 are used in the measurement. And one of them is fixed, the other is rotated at a constant speed then they are pressed by a predetermined force F as shown in FIG. 5. In that case, as the applying force F becomes greater, they receive a corresponding torque and become hard to rotate accordingly.

The above torque is measured and from the resultant figure and the force F applied, a coefficient of kinetic friction for said photosensitive drum member can be determined.

In practice, the coefficient of kinetic friction often depends upon the force F to be applied and also upon the revolution speed of the photosensitive drum member.

In such case, the coefficient of kinetic friction can be determined as follows.

That is, in the case where it depends upon the force F, a force F is applied in different quantities, the value of a coefficient of kinetic friction obtained in each case is plotted on a graph and the value obtained by extraporating the force F to zero in the result is considered as the coefficient of kinetic friction for that member.

In the case where it depends upon the revolution speed, the value of a coefficient of kinetic friction obtained in accordance with each revolution speed as employed is plotted on a graph and the value obtained by extraporating the revolution speed to zero is considered as the coefficient of kinetic friction for that member.

And, in the case where an extraporation is necessary to be made for the above two things, the point extremely near to zero will sometimes come to the result of measuring an instability and also a coefficient of static friction. In this respect, a graph is drawn excluding such point to thereby make said extraporation.

Further, there will occur a difference between a firstly obtained value and a lastly obtained value for the coefficient of kinetic friction when the measurement is repeatedly carried out using the same drum member. In that case, the first value is adopted.

There can be mentioned heat generation caused by the friction between the two members, abrasion of those members, occurrence of fine particles caused by such phenomena, etc. as the cause to invite the foregoing changes in the resulting coefficient of kinetic friction.

Therefore, the measurement of a coefficient of kinetic friction is desired to be made under such conditions that do not cause these phenomena.

By the way, in accordance with the above mentioned procedures, a coefficient of kinetic friction was measured on an OPC photosensitive drum member, an amorphous photosensitive drum member, a selenium photosensitive drum member and a carbonic photosensitive drum member of this invention respectively. As a result, there were obtained a value of 0.6 to 0.7 for each of the OPC drum member and the selenium drum member and a value of 0.7 to 0.8 for the amorphous drum member.

As for the carbonic drum member of which photoconductive layer having more than 65% of a carbon content which was prepared under a high substrate temperature condition, there was obtained a value of 0.05 to 0.2.

From the above result, there can be recognized the fact that the carbonic film in this invention is of a low coefficient of kinetic friction.

This low coefficient of kinetic friction for the carbonic film in this invention can be further lowered by incorporating fluorine atom thereinto.

In addition, in order to make the electrophotographic photosensitive member to be such that more effectively meets the foregoing objects, the carbonic film to constitute the photoconductive layer is desired to be such that has a gap state density, preferably, of $5\times10^{17}$ $cm^{-3}$ or less.

What the carbonic film the nucleus of which matrix being carbon atom and having the foregoing specific physical properties is highly insulative but has a wealth of many practically applicable characteristics is objectively confirmed by Examples of this invention.

By the way, the measurement of the foregoing gap state density for the carbonic film can be practiced using either a known capacitance method or a known field-effect method to be employed in the field of semiconductor.

There are commonly mentioned a structural defect, an impurity level, etc. which are caused by dangling bonds and the like as the cause that a gap state is increased in the case of an amorphous silicon photosensitive drum member. This is yet clear as a matter of fact, however it can be considered that such structural defect would be present also in the case of a known carbon film.

A most typical embodiment of the electrophotographic photosensitive member (undivided function type) according to this invention will be explained while referring to FIG. 1.

In FIG. 1, there are shown a substrate 11 and a photoconductive layer 12 having a free surface, which is constituted with a carbonic film the nucleus of which being carbon atom.

The photoconductive layer 12 contains at least one selected from hydrogen atom and halogen atom.

It is not desirable for the photoconductive layer to contain it in a large amount. It is preferably 15 atomic or less, and more preferably, 10 atomic % or less.

The incorporation of halogen atom in an excessive amount invites problems such as decrease in the photosensitivity, increase of a residual potential and easiness of being damaged for the surface.

On the other hand, the incorporation of halogen atom in a limited amount as mentioned above brings about significant effects such as improvements not only in the cleaning properties but also in the charge-retentivity, and decrease of a residual potential on the electrophotographic photosensitive member.

The photoconductive layer 12 may also contain nitrogen atom. In this case, the above mentioned effects in the case where halogen atom is incorporated may be further enhanced. Further, it is possible to further improve the charge-retentivity of the photoconductive layer 12 by incorporating oxygen atom thereinto.

For the photoconductive layer 12, when it is of a excessively large electric conductivity, problems such as decrease in the charge-retentivity and occurrence of an unfocused image (that is a smeared image) will be often brought about. In this respect, it is desired to be such that has an electric conductivity of $10^{-11}\Omega^{-1}cm^{-1}$ or less.

In addition, the photoconductive layer 12 is desired to be such that has an optical band gap (Egopt) preferably of more than 1.5 eV and more preferably, of more than 2.0 eV.

The composition of the photoconductive layer 12 comprising a carbonic film the nucleus of which matrix being carbon atom may be amorphous or may be such that at least partially contains a crystalline structure region of diamond. More particularly, in the latter case, it is desired to be such that at least partially contain such a structure characterized by a Stokes line in a region containing 1333 $cm^{-1}$ of Raman spectrum. In the case where the photoconductive layer 12 is constituted with a carbonic film containing a complete diamond structure region in a certain amount, the charge-retentivity, photosensitivity, surface hardness, durability, etc. of the electrophotographic photosensitive member may be all enhanced. In this case, it is preferred for said diamond structure region to be composed of a smaller particle size as much as possible.

As above described, the carbonic film to constitute the photoconductive layer 12 can be effectively improved to have a wealth of many practically applicable excellent characteristics by incorporating a dopant (III,V) thereinto.

The amount of the dopant (III,V) to be incorporated is preferably 5 atomic ppm to 5 atomic % and more preferably, 50 atomic ppm to 1 atomic %.

As the dopant of group III, there can be mentioned B, Al, Ga, In and Tl. As the dopant of group V, there can be mentioned N, P, As, Sb and Bi. Among these dopants, N, P, B and Al are particularly preferred.

As above also described, the thickness of the photoconductive layer 12 is properly determined depending upon the requirements for the photoconductive layer 12 of the electrophotographic photosensitive member to be prepared.

However, it is preferably 1 μm to 100 μm and more preferably, 5 μm to 50 μm.

That is, in the case where the thickness of the photoconductive layer 12 is less than 1 μm, there will often occur a problem that in view of the image developing as a visualization means, a satisfactory visible image density cannot be obtained by conventional developing process.

On the other hand, in the case where the above thickness is more than 100 μm, not only a residual potential becomes greater but also there occur other problems that a residual potential becomes considerably greater, the adhesion between the photoconductive layer 12 and the substrate 11 becomes poor and it takes an undesirably long time to form the layer.

In view of this, the thickness of the photoconductive layer 12 should be selected within the above mentioned range, and it is desirable to lie in the range from 5 μm to 50 μm.

The electrophotographic photosensitive member of which photoconductive layer (the photoconductive layer 12) is of a thickness lying in the above mentioned specific range is indeed advantageous since the use conditions therefor can be simplified and a high density visible image may be always made even in the case where the thickness of the photoconductive layer 12 is thinner than that of the photoconductive layer of a known electrophotographic photosensitive member.

In addition to the above advantages, it is also advantageous in the viewpoint that it can be produced in a smaller production in comparision with that required for the production of a known electrophotographic photosensitive member.

The electrophotographic photosensitive member shown in FIG. 1 can be immobilized as an electrophotographic photosensitive member of undivided function type.

In a preferred embodiment of that case, the photoconductive layer 12 itself is so made as to be accompanied with a sufficient function to generate a carrier, for example, by making it to contain a certain quantity of a double bond "c=c" in its structure.

By the way, the film structure of the carbonic film to constitute the photoconductive layer 12 can be observed for instance, by Raman analysis. In the case where the carbonic film has a complete graphite structure, a sharp Raman peak is detected in the region near 1580 $cm^{-1}$. And as a disorder from the graphite structure becomes greater (that is, the crystallinity is broken to become amorphous-like structure), a new Raman peak begins appearing in the region near 1360 $cm^{-1}$ when the above Raman peak is shifted toward the high frequency side, then a shoulder starts appearing in the region near 1620 $cm^{-1}$. In addition, the width of the peak becomes wider.

In the case where the carbonic film has a diamond structure composed of carbon of $SP^3$, a very sharp peak is detected in the region of 1333 $cm^{-1}$. Depending upon the width of this peak, it can be determined of whether it is of a high crystallinity or of an amorphous property.

For the carbonic film to constitute the photoconductive layer 12, it is desired to be so formed as to have a value of, preferably, 0.16 to 1.9 and more preferably, 1.6 to 1.9 for the ratio of $I_D/I_G$ between the peak intensity ($I_D$) of 1333 $cm^{-1}$ and the peak intensity ($I_G$) of 1580 $cm^{-1}$ in Raman spectra.

For the above peak intensity of a Raman spectrum, there is employed a value which is obtained by peak-dividing the resultant Raman spectra in accordance with a conventional method in this technical field and extraporating on each divided predetermined peak in accordance with a conventional triangular approximation method.

In the case where the carbonic film to constitute the photoconductive layer 12 is such as above mentioned, it can be very effectively doped with an element of group III, group IV or group V of the Periodic Table whereby its photoelectric characteristics being remarkably improved.

It is possible to form a desirable carbonic film to constitute the photoconductive layer 12 which has a value of less than 0.5 for the coefficient of kinetic friction under the specific conditions as long as it has a carbon content of more than 65 atomic % even in the case where it is doped with such element.

Now, as above described, the carbonic film to constitute the photoconductive layer 12 is desired to be such that has a gap state density preferably of $5\times10^{17}$ $cm^{-3}$ or less, and more preferably, of $1.5\times10^{17}$ $cm^{-3}$ or less.

In the case where the carbonic film is of a considerably large gap state density, a electric charge (carrier) is easily trapped during its transportation to cause problems such as increase of a residual potential, etc. which bring about undesirable influences on the quality of a image obtained.

It is possible to form a carbonic film having such desirable gap state density as mentioned above by carrying out the film forming process under specific conditions or by incorporating hydrogen atom and halogen atom or nitrogen atom thereinto under controlled conditions depending upon the requirement therefor.

As for the substrate 11 of the electrophotographic photosensitive member according to this invention, it may be electroconductive or electrically insulating. However, in the case where photosensitive member is to be used repeatedly, at least its surface on which a photoconductive layer is to be disposed is desired to be made conductive.

Usable as an electroconductive substrate are, for example, metals such as Al, Fe, Ni, Sn, Zn, Cr, Mo, Ti, Ta, W, Au, Ag, Pt, Pd and the like, or alloys such as stainless steel and other alloys of said metals, and other than these, Si, Ge or graphite.

For a purpose of improving the adhesion of the photoconductive layer 12 to the surface of such electroconductive substrate or for other purposes, said surface may be coated with other material than that of the substrate.

Usable as an electrically insulating substrate are, for example, films or sheet of synthetic resin such as polyester, polyethylene, polyurethane, polycarbonate, polystyrene, polyamide and the like, and other than these, glass or ceramics.

The size or the shape may be optionally determined. Examples of the shape are drum, belt, plate and suitable like shapes.

In the electrophotoconductive photosensitive member of this invention, it is possible to dispose a charge injection inhibition layer between the substrate 11 and the photoconductive layer 12 comprising the foregoing carbonic film.

In that case, a further improvement is made in the charge-retentivity and occurrence of a defective image is effectively prevented.

As such charge injection inhibition layer, a carbonic film or a silicon containing amorphous film containing hydrogen atom and a semiconductive impurity respectively in proper amounts can be used.

Among these films, said carbonic film is rather preferred for the reason that in this case, the foregoing charge injection inhibition layer and the photoconductive layer 12 can be continueously formed by means of controlling the flow rates and the flow ratios of raw material gases to be introduced into a deposition chamber.

And, for the above electrophotographic photosensitive member according to this invention which comprises the substrate 11, the foregoing charge injection inhibition layer and the photoconductive layer, when it is for use in positive polarity charge, it is necessary for the foregoing charge injection inhibition layer to be of a p-type semiconductor property or a low electron mobility. On the other hand, when it is for use in negative polarity charge, the foregoing charge injection inhibition layer is necessary to be of an n-type semiconductor property or a low hole mobility.

As above described, the carbonic film to constitute the photoconductive layer of the electrophotographic photosensitive member according to this invention can be properly formed by means of vacuum vapor deposition wherein raw material gases are excited, ionized or decomposed with an appropriate activation energy such as discharge energy, heat energy or light energy to thereby cause the formation of the carbonic film on the substrate.

In that event, it is possible to make the resulting carbonic film to be a desirable one having an excellent film quality and also to promote the deposition rate for the formation of such carbonic film by subjecting the substrate to the action of an accelating election during the film forming process, accelating an ion generated during the film forming process with an electric field, or impressing a magnetic field to a plasma generation region of the deposition chamber.

It is of course possible to form the carbonic film by means of reactive sputtering wherein there is used a solid carbon or other solid of which main ingredient is a carbon compound as a target.

Details of the film formation mechanism are yet clarified, but it is an important factor in order to obtain a desired carbonic film that a carbon ion, or an ion of a carbon compound and a radical of said carbon compound be generated in the film forming process in any case.

In addition, in the case where hydrogen atom is to be structurally incorporated into the film, an amount of a raw material gas imparting hydrogen atom to be fed is an important factor in order to a high quality carbonic film. In this case, it is preferred to generate to excite at least part of said raw material to thereby generate a hydrogen ion or a hydrogen radical prior to being surved for film formation.

Further, in order to form a desired carbonic film, it is effective to impress a vias voltage from a power source onto the substrate so as to make its surface on which a film is to be deposited exposed for ion impacts or to accelate an electron toward the direction of the substrate so as to excite a raw material with such electron in a space near the surface of the substrate.

In the latter case, it is possible for such electron to be supplied using a plasma or using a heated filament.

Further, even in such case where said bias voltage is not impressed onto the substrate, it is desirable to utilize such outobias caused by impressing a high frequency on the substrate side without the substrate being grounded as in the case of practicing RF Plasma chemical vapor deposition.

The temperature of the substrate upon practicing the film forming process is an important factor in order to obtain a desired carbonic film.

In general, it is made to a temperature of more than 250° C.

Now, the conditions for forming the photoconductive layer of the electrophotographic photosensitive member according to this invention are varied depending upon a film forming method, an apparatus to be used for practicing said method, its scale, the kind of its constituent member, the kind of a raw material to be used, etc. And respective parameters for forming said photoconductive layer cannot be usually determined with ease independent of each other but should be decided based on relative and organic relationships among those parameters.

Specifically, in the case of chemical vapor deposition utilizing glow discharge, in general, preferred parameters are: 250 to 650 W for the discharging power (Pw); $7\times10^{-4}$ to 10 Torr for the inner pressure (P) during film forming process; 250 to 700° C. for the substrate temperature (Ts); −300 to zero V for the substrate bias ($E_{SUB}$); and as for the magnetic field (H); 400 to 800 Gauss in the case of RF and 875 Gauss or around this in the case of microwave.

However, in this invention, the actual condition for forming the photoconductive layer comprising a desired carbonic film are to be properly designed by selecting appropriate respective parameters from those above mentioned depending upon an apparatus to be used so that said carbonic film can be effectively formed.

In this case, a dark conductivity for the resulting carbonic film can be appropriately reduced by properly heightening the discharging power, the substrate temperature and the substrate bias respectively. In the case where a raw material gas of a carbon compound and hydrogen gas are used, said dark conductivity can be raised by increasing the flow ratio of said raw material gas to said hydrogen gas.

As for the band gap for the resulting carbonic film, it can be enlarged by using properly selected raw material gases or by properly heightening the discharging power, the substrate temperature and the substrate bias respectively.

As for the coefficient of kinetic friction for the resulting carbonic film, it can be reduced by properly heightening the discharging power, the substrate temperature and the substrate bias respectively in general. In alternative, it can be reduced also by decreasing the flow rate of a raw material gas of a carbon compound in the case where it is used.

In this invention, the actual conditions for forming an objective desired carbonic film are properly determined while having due regards on what are above mentioned.

Details of this situation are explained by Examples of this invention which will be under described.

Usable as the carbon compound to be used for forming the foregoing carbonic film to constitute the conductive layer 12 of the electrophotographic photosensitive member according to this invention are, for example, alkane series hydrocarbons or their derivatives such as methane, ethane, propane, butane, etc.; alkylene series hydrocarbons or their derivatives such as ethylene, propylene, butylene, amylene, etc.; alkyne series hydrocarbons or their derivatives such as acetylene, pentyne, butyne, hexyne, etc.; aromatic hydrocarbons or their derivatives such as benzene, naphthalin, anthracene, toluene, xylene, pyridine, picoline, quinoline, indole, acridine, phenol, cresol, etc.; various alcohols such as methanol, ethanol, propanol, butanol, etc.; various ketones or their derivatives such as acetone, methylethyl ketone, diethyl ketone, di-isopropyl ketone, di-isobutyl ketone, diacetyl, etc.; various aldehydes or their derivatives such as acetoaldehyde, propionaldehyde, butylaldehyde, etc.; various amines or their derivatives such as methylamine, dimethylamine, trimethylamine, ethylamine, propylamine, etc.; various ethers or their derivatives such as dimethylether, methyethylether, isopropylether, methyl-n-butylether, etc.; and various acetates such as ethylacetate.

And, usable as a compound to be used in the case where fluorine atom is incorporated into the above carbonic film are, for example, fluoromethane, fluoropropane, fluorocyclohexane, methane difluoride, methane trifluoride, methane tetrafluoride, fluoroacetylene, fluorobenzene, acetyl fluoride, formyl fluoride, etc.

In order to incorporate fluorine atom into the above carbonic film, it is a matter of course that the sole use of a fluorine gas is effective.

And as for the above mentioned fluorine compounds, one or more of them can be independently used.

Other than the above case, one or more of them can be used together with a hydrocarbon compound or together with a hydrogen gas.

In the case where the chosen fluorine compound is in a liquid state or in a solid state, it is contacted with a carrier gas such as Ar, $H_2$, etc. and if necessary, while being heated to thereby generate a gas of the compound, which is then introduced into the deposition chamber.

It is possible to introduce other halogen gas or/and ammonia gas together with such gaseous substances as above mentioned.

In the case where a dopant (III,V) is incorporated into the above carbonic film, a hydrogenated substance such as $BH_3$, $B_2H_6$, $PH_3$, $AsH_3$ or $NH_3$, or other than these, $Al(CH_3)_3$ or $Ga(CH_3)_3$ can be desirably used as a raw material to impart the dopant (III,V).

Explanation will be now made about representative fabrication apparatuses suited for practicing the film forming process of the foregoing carbonic film to constitute the photoconductive layer of the electrophotographic photosensitive member according to this invention.

Figure 2:
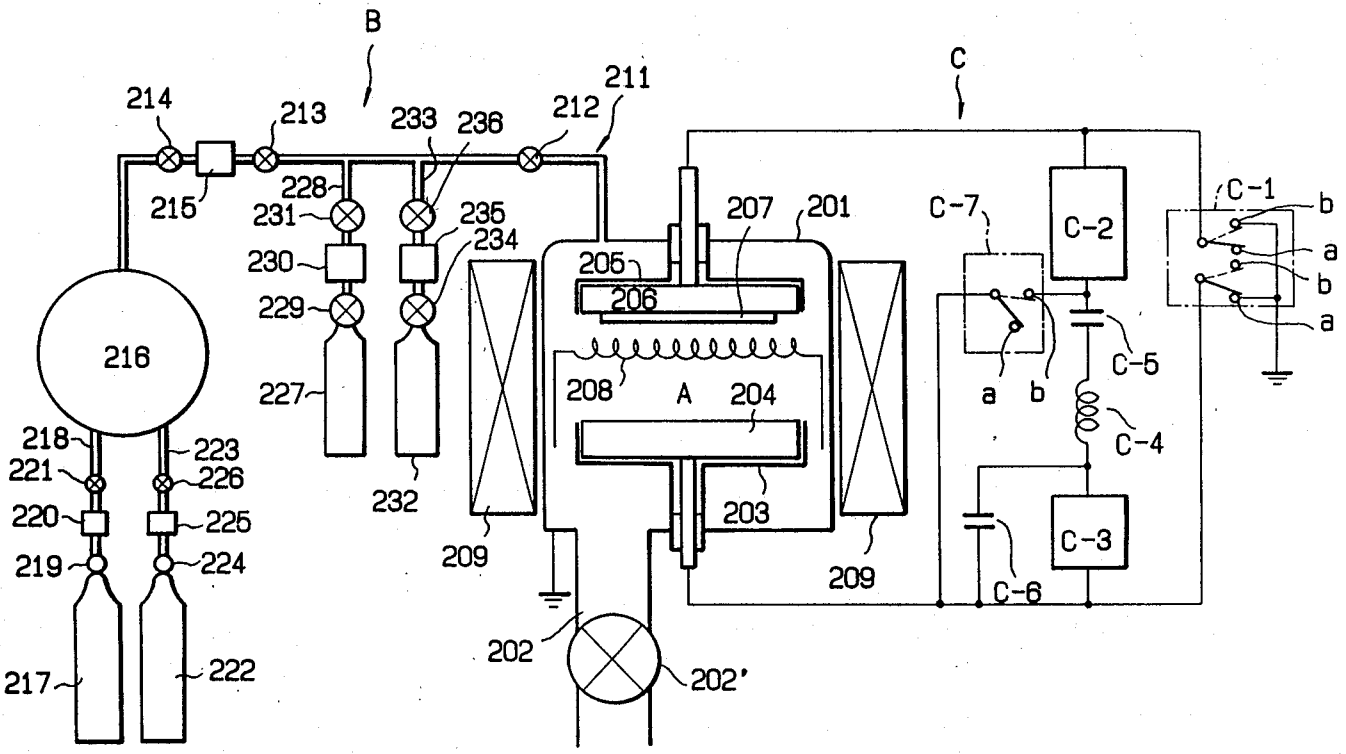
FIG. 2 is a schematic explanatory view of a fabrication apparatus as an example of the apparatus for preparing the electrophotographic photosensitive member according to this invention.

In FIG. 2, there is shown one of such representative fabrication apparatus.

The apparatus shown in FIG. 2 comprises a deposition chamber, a gas supplying system B and a high frequency supplying system C.

In FIG. 2, there is shown a substantially enclosed cylindrical deposition chamber 201 with which a water cooling means capable of cooling its entire part is provided (not shown). With the bottom of which, there is provided an exhaust pipe 202 being connected though a main valve 202' to a vacuum pump (not shown). Numerals 204 and 206 stand for electrodes which are arranged in film forming space A of the deposition chamber 201 so that a voltage of direct current (DC) or alternating current (AC) can be impressed. Numeral 203 is a guard-electrode for the electrode 204 and numeral 205 is a guard-electrode for the electrode 206. On the surface of the electrode 204, it is possible to place a target for reactive sputtering.

Numeral 207 is a substrate placed on the surface of the electrode 206. Numeral 208 is an electric heater for the substrate 207 which is made of a metal such as tungsten, tantalum, etc., and which is so installed in the film forming space A that its position can be automatically adjusted (not shown). The electric heater 208 may be of a wire shape or a coil shape, or other than these, it may be a wire net. And, in order to actuate the electric heater 208, an AC power, for example, of 50 Hz is impressed thereto. Not only the deposition chamber but also the guard-electrodes 203 and 205 are electrically grounded. As for the grounding means for the guard-electrodes 203 and 205 (not shown), they are removably provided.

With the circumferential outer wall face of the deposition chamber 201, a metal coil 209 is windingly provided. In case where necessary, a DC is impressed to the metal coil 209 to thereby cause a static magnetic field in the film forming space A.

In the high frequency supplying system C, there is shown a high frequency power source C-2 of 13.56 MHz, which is so designed that its machine can be made depending upon a load impedance. And there are also shown a DC power source C-3, capacitors C-5 and C-6, and an inductance coil C-4. In the high frequency supplying system C, there are provided alteration circuits C-1 and C-7 in order to shunt a high frequency impressing side one to the other between the electrodes 204 and 206.

In the gas supplying system, there is shown a raw material gas feed pipe 211 which is connected to the deposition chamber 201. Numerals 217, 222, 227 and 232 are gas reservoirs for gases to be used for forming the carbonic film such as raw material gas, dopant imparting raw material gas, carrier gas and etching raw material gas.

The feed pipe 211 is connected through gas pipes 218, 223, 228 and 233 to respective reservoirs 217, 222, 227 and 232.

Numeral 216 stands for a vessel for the dilution of a high concentration raw material gas to which the reservoirs are connected through the gas pipes 218 and 223.

Numerals 212, 213, 214, 219, 221, 224, 226, 229, 231, 234 and 236 are valves for controlling the flow rates of the gases from the reservoirs 217, 222, 227 and 232. And numerals 215, 220, 225, 230 and 235 are mass flow controllers.

Figure 3:
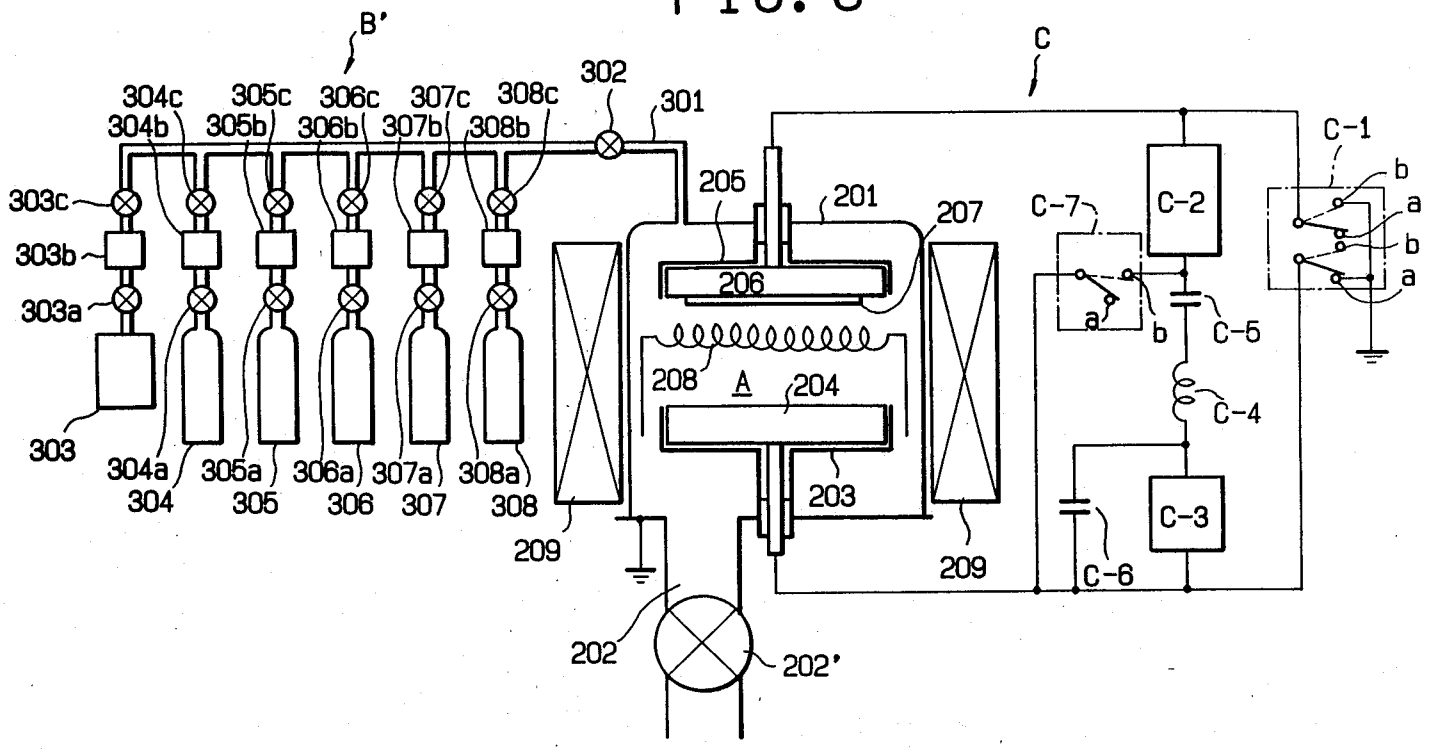
FIG. 3 is a schematic explanatory view of a fabrication apparatus as another example of the apparatus for preparing the electrophotographic photosensitive member according to this invention.

In FIG. 3, there is shown another representative apparatus also suited for practicing the film forming process of the foregoing carbonic film to constitute the photoconductive layer of the electrophotographic photosensitive member according to this invention.

The apparatus shown in FIG. 3 is a modification of the apparatus shown in FIG. 2 in which the gas supplying system is modified into the way of B' as shown in FIG. 3. That is, in the gas supplying system B' of the apparatus shown in FIG. 3, there are shown reservoirs 303, 304, 305, 306, 307 and 308 for gases to be used for forming the carbonic film such as raw material gas, dopant imparting raw material gas, carrier gas and etching raw material gas, which are connected to the gas feed pipe 301 respectively through respective gas pipes. With the respective gas pipes, there are provided control valves 303*a* through 308*a*, another control valves 303*c* through 308*c* and mass flow controllers 303*b* through 308*b* respectively.

Figure 4:
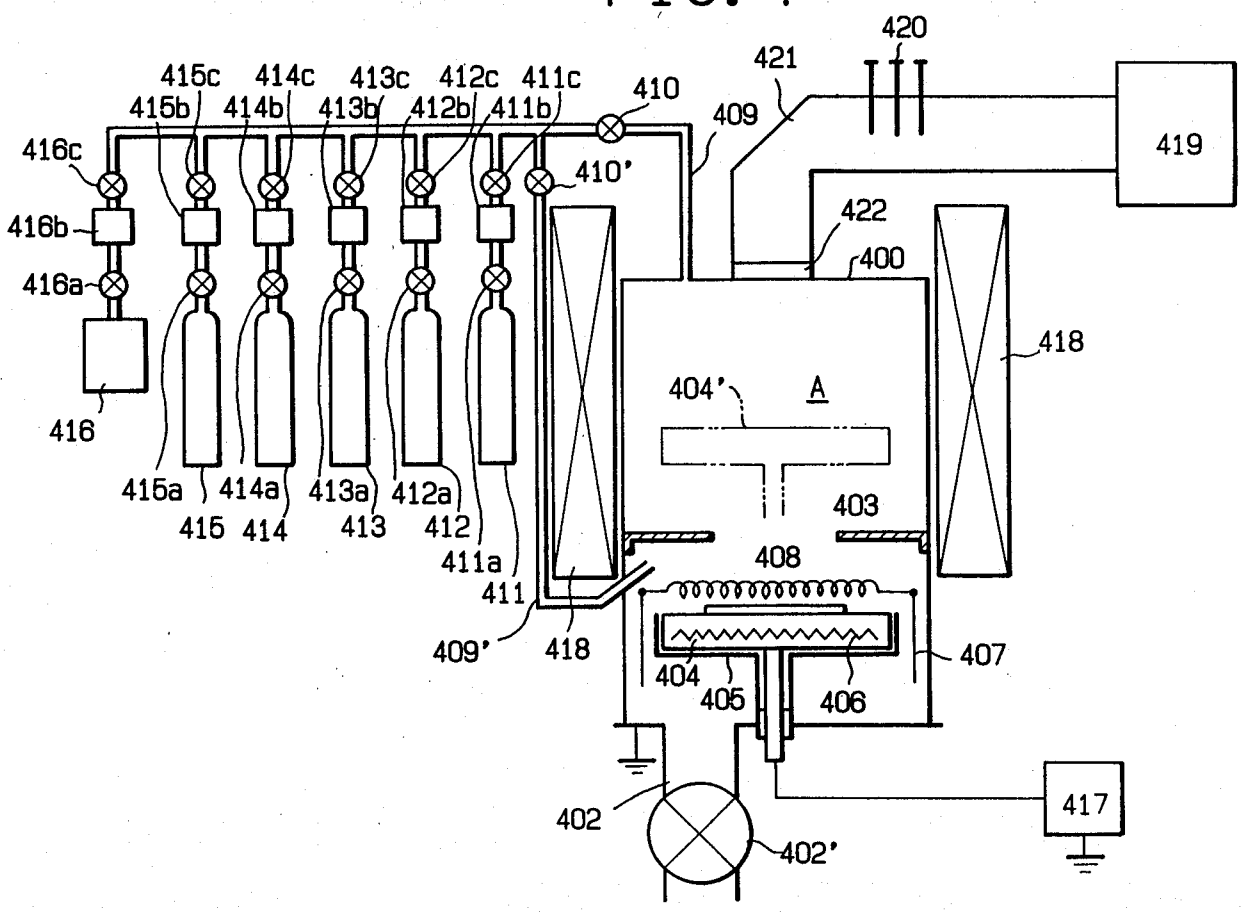
FIG. 4 is a schematic explanatory view of a fabrication apparatus as a further example of the apparatus for preparing the electrophotographic photosensitive member according to this invention.

In FIG. 4, there is shown a further representative apparatus suited for practicing the film forming process of the foregoing carbonic film to constitute the photoconductive layer of the electrophotographic photosensitive member according to this invention.

In FIG. 4, numeral 400 stands for a substantially enclosed deposition having film forming space A, with which an exhaust pipe 402 is provided. The exhaust pipe 402 is connected through a main valve 402' to a vacuum pump (not shown).

In the middle of the upper wall of the deposition chamber 400, there is embeded a microwave introducing window 422 made of a microwave hardly absorptive material such as a quartz place in a state to form a part of said upper wall. Numeral 403 is a substrate which is placed on the surface of a substrate holder 402 in which an electric heater 406 is installed. Numeral 405 is a guard-electrode. Numeral 407 is an electric heater for substrate 403. The substrate holder 404 is provided in a state being insulated from being grounded. Numeral 417 is a DC power source to impress a voltage thereonto. Numeral 408 stands for a parting strip, which is slidably provided with the inner face of the circumferential side wall of the deposition chamber in the way to allow its upward and downward movements. The parting strip 408 serves to reflect a microwave introduced through the window 422 and to make the microwave effectively absorbed into raw material gases and the like which are fed into the film forming space.

In the apparatus shown in FIG. 4, the substrate holder 404 is so installed that it can be lifted to the position of 404' in the film forming space A in case where necessary.

Numeral 421 is a waveguide for a microwave from a microwave power source 419, which is connected through the microwave introducing window 422 to the deposition chamber 400. With the waveguide 421, there is provided a tuner 420 serving for the matching of an impedance.

With the circumferential outer wall face of the deposition chamber 400, a metal coil 418 is windingly provided. In case where necessary, a DC is impressed to the metal coil 418 to thereby cause a static magnetic field in the film forming space A.

Numeral 409 is a gas feed pipe of a gas or gases from reservoirs 411 through 416, which is open through the upper wall of the deposition chamber 400 into the film forming space A.

Numeral 409' is a branched gas feed pipe from the gas feed pipe 409, which is open through the circumferential side wall of the deposition chamber 400 into a lower part of the film forming space A.

The reservoirs 411 through 416 serves to store gases to be used for forming the carbonic film such as raw material gas, dopant imparting raw material gas, carrier gas and etching raw material gas.

Numerals 411*a* through 416*a* and 411*c* through 416*c* are valves for controlling the flow rates of the gases from the reservoirs 411 through 416.

Numerals 411*b* through 416*b* are mass flow controllers. And numerals 410 and 410' are valves having two functions to operate as both regulation valves and switching valves.

PREFERRED EMBODIMENT OF THE INVENTION

The advantages of this invention are now described in more detail by reference to the following Examples, which are provided merely for illustrative purposes only, and are not intended to limit the scope of this invention.

EXAMPLE 1

An electrophotographic photosensitive member in a drum form according to this invention was prepared using the partially remodeled of the fabrication apparatus shown in FIG. 2 in which a cylindrical substrate can be used in stead of the substrate 207, it can be rotated during the film forming process and it can act also as an electrode in stead of the electrode 206, in addition, the circumferential inner wall of the deposition chamber 201 can act another electrode in stead of the lower electrode 204.

In this example, there was used a high purity aluminum 6064 clinder was used as the substrate.

After the cylindrical substrate being cleaned, it was rotatably attached to and suspended from the upper guard-electrode 205. The deposition chamber was substantially enclosed, and the air of the film forming space was evacuated by opening the main valve 202' to bring the chamber to vacuum of about $2\times10^{-7}$ Torr. Then, an AC power of 50 Hz was impressed to the tungsten coil electric heater 208 being so installed as to position along and over the cylindrical substrate being suspended in the film forming space A and the heater was heated to about 2500° C. to thereby cause a radiant heat. Using which heat, the cylindrical substrate was heated while being rotated until the temperature of its reverse side which is not faced to the heater 208 becomes to be about 350° C. [measured using a thermocouple (not shown)]. Thereafter, the temperature of the heater 208 was reduced to about 2000° C. to thereby make the temperature of the cylindrical substrate stable.

Then, a DC power was impressed to the metal coil to make the magnetic field on the upper inner face part of the circumferential side wall of the deposition chamber to be 800 Gauss.

The switching positions in the alteration circuits C-7 and C-1 were turned to the position a and the polarity of the DC power source C-3 was so adjusted that the cylindrical substrate side became −100 V.

Thereafter, minimizing the mass flow controllers 230 and 235, the valves 229 and 231 for the reservoir 227 in which $C_2H_2$ being stored and the valves 234 and 236 for the reservoir 232 in which $H_2$ being stored are opened. Further, minimizing the mass flow controller 215, the valves 213 and 214 for the vessel 216 were opened. Furthermore, minimizing the mass flow controllers 220 and 225, the valves 219 and 221 for the reservoir 217 in which a gas containing $B_2H_6$ in 5 mol % concentration in hydrogen gas (hereinafter referred to as "$B_2H_6/H_2$ gas") being stored and the valves 224 and 226 for the reservoir 222 in which $H_2$ being stored were opened.

Successively, the mass flow controllers 215, 220, 225, 230 and 235 were so regulated that the flow rates of a diluted gas from the vessel 216, of $B_2H_6/H_2$ gas from the reservoir 217, of $H_2$ gas from the reservoir 222, of $C_2H_2$ gas from the reservoir 227, and of H2 gas from the reservoir 232 became 10 SCCM, 40 SCCM, 60 SCCM, 20 SCCM and 90 SCCM respectively. In this event, the inner pressure of the film forming space was 0.06 Torr.

Then, the power sources C-2 and C-3 were switched on to thereby start discharging under the condition of power supply of 350 W. After 40 minutes since the discharge and the inner pressure became stable, the flow rate of $B_2H_6/H_2$ gas from the reservoir 217 was linearly decreased to the level of 0.4 SCCM in an hour while continuing the film forming operation. The film forming operation was still continued thereafter, and after 30 minutes lapsed, the mass flow controller 230 was gradually closed so as to make the flow rate of $C_2H_2$ gas to be 3 SCCM at the final stage when 6 hours lapsed. The film forming operation was still continued, and after 42 hours lapsed, the power sources C-2 and C-3 were switched off to stop charging and the valve 212 was closed to stop the supply of said gases at the same time.

The power source for the heater 208 was switched off, and the cylindrical substrate was sufficiently cooled. Breaking the vacuum of the deposition chamber 201, the cylindrical substrate having a deposited carbonic film to be the photoconductive layer on its surface was taken out therefrom.

Photoconductivity and charge-retentivity were measured on the resultant member in accordance with known measuring methods in the technical field of electrophotography.

Excellent results were obtained on every item, and it was recognized that the resultant member can be immobilized as a practically usable electrophotographic photosensitive member.

Then, it was set to a remodeled Canon's electrophotographic copying machine NP 7550 for experimental purposes (product of Canon Kabushiki Kaisha) to evaluate its resolution and image making function.

As a result, it was found that an excellent high quality visible image of a high resolution can be continueously obtained even after ten thousand shots.

In addition, as a result of subjecting the resultant deposited carbonic film formed on the cylindrical substrate to chemical composition analysis, it was found that it is composed of a carbonic structural material, the nucleus of which matrix being carbon atom and which contains hydrogen atom in an amount of 5 atomic %.

EXAMPLE 2

The procedures of Example 1 were repeated, except that the film forming conditions were changed as below mentioned, to thereby prepare an electrophotographic photosensitive member according to this invention.

That is, $C_2H_2$ gas was fed at a flow rate of 20 SCCM at the initial stage and said flow rate was gradually decreased to the level of 3 SCCM in 7 hours.

As for $B_2H_6/H_2$ gas, it was fed at a flow rate of 40 SCCM at the initial stage and said flow rate was gradually decreased to the level of 5 SCCM in 1.5 hours. After 7 hours since the commencement of the film forming operation, the flow rates of $C_2H_2$ gas and $H_2$ gas were controlled to be 3 SCCM and 100 SCCM respectively, and under this condition, the film forming operation was continued for further 40 hours to thereby obtain an objective electrophotographic photosensitive member.

As a result of chemical composition analysis for the resultant deposited carbonic film to be the photoconductive layer, it was found that it is composed of a carbonic structural material, the nucleus of which matrix being carbon atom and which contains hydrogen atom in an amount of 7 atomic %.

And, as a result of evaluating the resultant photosensitive member in the same way as in Example 1, it was found that it excels in charge-retentivity, and it continueously gives an excellent high quality image of a high resolution.

EXAMPLE 3

Using the same apparatus as used in Example 1, there was prepared an electrophotographic photosensitive member in a drum form according to this invention in the following way.

In this example, there was used a high purity aluminum cylindrical substrate.

Firstly, the film forming operation was carried out under the following conditions for first 10 hours;

| | |
|---|---|
| substrate temperature | 350° C. |
| gas used and its flow rate | |
| methyl bromide | 5 SCCM |
| $H_2$ | 100 SCCM |
| $PH_3/H_2$ (10 mol %) | 0.5 SCCM |
| inner pressure | 0.5 Torr |
| RF power | 600 W |
| magnetic field | 400 Gauss |
| substrate bias | −200 V |

Thereafter, discharging was still continuted while gradually increasing the flow rate of said $PH_3/H_2$ gas in the proportion of 0.01 SCCM/min for further an hour. Successively, the film forming operation was continued for further 30 minutes while gradually decreasing the flow rate of said methyl bromide in the proportion of 0.1 SCCM/min and at the same time, gradually decreasing the flow rate of said $PH_3/H_2$ gas in the proportion of 0.02 SCCM in that period.

Then, the discharging was stoped and at the same time, the supply of gases was stoped. The resultant photosensitive member was set to a conventional charge polarity measuring machine to examine its charge polarity.

As a result, it was found that it has a positive charge polarity.

And, as a result of evaluating the resultant photosensitive member in the same way as in Example 1, it was found that it excels in charge-retentivity, and it continueously gives an excellent high quality image of a high resolution.

In addition, it was also found that the photoconductive layer of the resultant photosensitive member contains hydrogen atom in an amount of 5 atomic %.

EXAMPLE 4

There was prepared an electrophotographic photosensitive member in a drum form according to this invention using the same apparatus as used in Example 1 and repeating the procedures of Example 1 except that the valve 213 always maintained as closed and $CH_4$ was used in stead of $C_2H_2$.

There was used a high purity aluminum 6064 cylinder as the substrate 207.

The deposition chamber was substantially enclosed, and the air of the film forming space was evacuated by opening the main valve 202' to bring the chamber to a vacuum of about $2\times10^{-7}$ Torr. Then, an AC power of 50 Hz was impressed to the tungsten coil electric heater 208 being so installed as to position along and over the cylindrical substrate 207 being suspended in the film forming space A and the heater was heated to about 2500° C. to thereby cause a radiant heat. Using which heat, the cylindrical substrate was heated while being rotated until the temperature of its reverse side which is not faced to the heater 208 becomes to be about 300° C. [measured using a thermocouple (not shown)]. Thereafter, the temperature of the heater 208 was reduced to about 2000° C. to thereby make the temperature of the cylindrical substrate stable.

Then, a DC power was impressed to the metal coil to make the magnetic field on the upper inner face part of the circumferential side wall of the deposition chamber to be 800 Gauss.

The switching positions in the alteration circuits C-7 and C-1 were turned to the position a and the polarity of the DC power source C-3 was so adjusted that the cylindrical substrate side became −100 V.

Then, minimizing the mass flow controllers 230 and 235, the valves 229 and 231 for the reservoir 227 in which $CH_4$ being stored and the valves 234 and 236 for the reservoir 232 in which $H_2$ being stored were opened, and at the same time, the valve 212 was also opened.

Successively, the mass flow controllers 230 and 235 were so regulated that the flow rate of $CH_4$ from the reservoir 227 and the flow rate of $H_2$ from the reservoir 232 became 10 SCCM and 100 SCCM respectively. In this event, the inner pressure of the film forming space A was 0.10 Torr.

Thereafter, the power sources C-2 and C-3 were switched on to thereby start charging under the condition of a power supply of 400 W and the film forming operation was commenced. After 30 minutes since all the related conditions became stable, the flow rate of said $CH_4$ from the reservoir 227 was gradually decreased to the level of 5 SCCM in an hour, and under this condition, the film forming operation was continued for 9 hours. Thereafter, the flow rate of said $CH_4$ from the reservoir 227 was gradually increased to the level of 15 SCCM in 3 hours, and under this condition, the film forming operation was continued for further 22 hours.

Then, the power sources C-2 and C-3 were switched off to stop charging and at the same time, the valves 229, 231, 234, 236 and 212 were all closed to stop the supply of said gases. At that time, the power source for the heater 208 was also switched off.

After sufficiently cooling the cylindrical substrate having a deposited carbonic film to be the photoconductive layer on its surface, it was taken out from the deposition chamber 201.

As a result of examining the structural state of the resultant deposited film, it was found that it has not any clear layer interface within its internal structure.

In addition, it was found that it is composed of a carbonic structural material, the nucleus of which matrix being carbon atom, and which contains hydrogen atom in an amount of 10 atomic %.

It was also found that the resultant electrophotographic photosensitive member always exhibit an excellent charge-retentivity in both positive and negative polarities. It was further found that it excels also in photoconductivity and it can be immobilized as a practically usable electrophotographic photosensitive member.

As a result of evaluating the image-making efficiency for the resultant electrophotographic photosensitive member in the same way as in Example 1, it was found that it continueously gives a satisfactory image in high image quality even after repeated use for a long period of time.

EXAMPLE 5

The procedures of Example 4 were repeated, except that the film forming conditions were changed as below mentioned, to thereby prepare an objective electrophotographic photosensitive member in a drum form according to this invention.

Firstly, the film forming operation was carried out under the following conditions;

| | |
|---|---|
| temperature of the reverse side of the cylindrical substrate at the beginning stage | 250° (using a AC power) |
| magnetic field | 800 Gauss |
| substrate bias | −100 V |

and, minimizing the mass flow controllers 230 and 235, the valves 229 and 231 for the reservoir 227 in which $CH_4$ being stored and the valves 234 and 236 for the reservoir 232 in which $H_2$ being stored were opened, and at the same time, the valve 212 was also closed. Then, the mass flow controllers 230 and 235 were so adjusted that the flow rate of said $CH_4$ and that of said $H_2$ became to be 10 SCCM and 100 SCCM respectively. In this event, the inner pressure of the film forming space A was 0.10 Torr.

Successively, the power sources C-2 and C-3 were switched on the start charging under the condition of a power supply of 400 W. After 30 minutes since all the related conditions became stable, the temperature of the reverse side of the cylindrical substrate was adjusted to 400° C. in 30 minutes, and under this condition, the film forming operation was continued for 7 hours. Thereafter, the temperature of the reverse side of the cylindrical substrate was gradually reduced to 300° C. in 5 hours while continuing the film forming operation, and under this condition, the film forming operation was continued for further 20 hours.

Then, the power sources C-2 and C-3 were switched off to stop charging and at the same time, the valves 229, 231, 234, 236 and 212 were all closed to stop the supply of said gases. At that time, the power source for the heater 208 was also switched off.

After sufficiently cooling the cylindrical substrate having a deposited carbonic film to be the photoconductive layer on its surface, it was taken out from the deposition chamber 201.

As a result of examining the structural state of the resultant deposited film, it was found that it has not any clear layer interface within its internal structure.

In addition, it was found that it is composed of a carbonic structural material, the nucleus of which matrix being carbon atom, and which contains hydrogen atom in an amount of 10 atomic %.

It was also found that the resultant electrophotographic photosensitive member always exhibit an excellent charge-retentivity in both positive and negative polarities. It was further found that it excels also in photoconductivity and it can be immobilized as a practically usable electro-photographic photosensitive member.

As a result of evaluating the image-making efficiency for the resultant electrophotographic photosensitive member in the same way as in Example 1, it was found that it continueously gives a satisfactory image in high image quality even after repeated use for a long period of time.

EXAMPLE 6

In this example, there was used the partially remodeled of the apparatus shown in FIG. 3 so that as the substrate 207, a cylindrical drum form substrate can be used in the same way as in the case of Example 1.

And, there was prepared an objective electrophotographic photosensitive member according to this invention.

The photoconductive layer of said photosensitive member was formed under the following film forming conditions; gas used and its flow rate:

| | |
|---|---|
| $C_2H_4$ | 5 SCCM |
| $H_2$ | 95 SCCM |
| $HF/H_2$ (10 mol %) | 3 SCCM |
| inner pressure | 0.06 Torr |

substrate temperature:

250° C. in the beginning stage, and said temperature is gradually increased to 350° C. in the proportion of 1° C./min. in a period of 100 minutes in the later stage

| | |
|---|---|
| RF power | 250 W |
| substrate bias | −100 V |
| magnetic field | 800 Gauss |

As a result of examining the coefficient of kinetic friction for the resultant photoconductive layer in accordance with the foregoing method, it was 0.25.

And, the resultant electrophotographic photosensitive member was set to a conventional experimental electrophotographic copying machine to examine its electrophotographic characteristics. As a result, it was found that it excels in charge-retentivity and also in photosensitivity.

Further, the resultant electrophotographic photosensitive member was tested by subjecting it to positive charge, image exposure and toner development, using said copying machine, as a result, a high quality toner image could be repeatedly obtained.

In addition, the result of subjecting the photoconductive layer to chemical composition analysis came to find that it is composed of a carbonic structural material, the neucleus of which matrix being carbon atom and which contains hydrogen atom in an amount of 14 atomic %.

EXAMPLE 7

There was prepared an objective electrophotographic photosensitive member according to this invention using the same apparatus as used in Example 6 and employing the procedures of Example 1.

The photoconductive layer of said photosensitive member was formed under the following film forming conditions;

gas used and its flow rate:

| | | |
|---|---|---|
| $C_2H_4$ | 10 SCCM | in beginning stage, and it was gradually decreased in the proportion of 1 SCCM/10 min. to 5 SCCM in 50 minutes in the later stage |
| $H_2$ | 60 SCCM | |

-continued

| | |
|---|---|
| $F_2$ | 20 SCCM |
| inner pressure | 0.06 Torr |
| substrate temperature | 350° C. |
| RF power | 350 W |
| magnetic field | 800 Gauss |
| substrate bias | −80 V |

The resultant electrophotographic photosensitive member was tested using a conventional experimental electrophotographic copying machine.

As a result, it was found that it excels in charge-retentivity and also in photosensitivity.

In addition, a high quality toner image could be repeatedly obtained.

A plurality of carbonic film samples of 1.5 μm in thickness were prepared under the same film forming conditions as in the above case for measuring the electric conductivity for and the concentrations of the hydrogen atom and the fluorine atom contained in the photoconductive layer. The results of these measurement came to find that the electric conductivity of the photoconductive is $1.3\times10^{-12}\Omega^{-1}cm^{-1}$, and the concentration for the hydrogen atom is 8 atomic % and that for fluorine atom is 5 atomic % respectively.

EXAMPLE 8

There was prepared an objective electrophotographic photosensitive member according to this invention using the same apparatus as used in Example 6 and employing the procedures of Example 1.

The photoconductive layer of said photosensitive member was formed under the following film forming conditions; gas used and its flow rate:

| | |
|---|---|
| $C_2H_4$ | 5 SCCM |
| $H_2$ | 95 SCCM |

$B_2H_6/H_2$ (10 mol%) 10 SCCM in the beginning stage, and it was then gradually decreased in an hour in the later stage

| | |
|---|---|
| inner pressure | 0.01 Torr |
| substrate temperature | 400° C. |
| RF power | 400 W |
| substrate bias | −100 V |
| magnetic field | 800 Gauss |

The resultant electrophotographic photosensitive member was set to a conventional experimental electrophotographic copying machine to examine its electrophotographic characteristics. As a result, it was found that it excels in charge-retentivity and also in photosensitivity.

In addition, the result of subjecting the photoconductive layer to chemical composition analysis came to find that it is composed of a carbonic structural material, the neucleus of which matrix being carbon atom and which contains hydrogen atom in an amount of 12 atomic %. And, as a result of observing the gap state density of the resultant photoconductive layer, it was found that it is $1.7\times10^{17}cm^{-3}$.

EXAMPLE 9

In this example, there was used the partially remodeled of the apparatus shown in FIG. 4 so that as the substrate 403, a cylindrical drum form substrate can be used, and said substrate can be rotated during the film forming operation.

And, there was prepared an objective electrophotographic photosensitive member according to this invention in the way as will be mentioned.

Initial film forming conditions employed; substrate used : a high prity aluminum cylinder gas used and its flow rate :

| | |
|---|---|
| $CH_4$ | 5 SCCM |
| $H_2$ | 50 SCCM |
| $B_2H_6/H_2$ (1 mol %) | 50 SCCM |
| microwave power | 100 W (2.45 GHz) |
| inner pressure | 10 Torr |
| magnetic field* | 875 Gauss |

*there was made to cause an electron cyclotron resonance.

Under the above conditions, the position of the parting strip 408 was so adjusted that the deposition chamber 400 could act as a cavity resonator for microwave. The resulting gas plasmas were made to blow through the opening of the parting strip 408 into the film forming space wherein the cylindrical substrate being placed.

Then, the substrate temperature was controlled to 600° C., and the substrate bias was made to be −150 V.

Under this condition, the film forming operation was continued for 25 hours. Thereafter, the flow rate of $CH_4$ was gradually increased in the proportion of 0.5 SCCM/min. to 50 SCCM while also gradually increasing the inner pressure to 15 Torr respectively in a period of 90 minutes, and it was successively continued for further 1.5 hours. Thereafter, the film forming operation was further continued while gradually decreasing the inner pressure in the proportion of 1 Torr/min. to 1 Torr and also gradually decreasing the flow rate of the $B_2H_6/H_2$ gas in the proportion of 1 SCCM/min., and it was still continued for successive 4 hours, to thereby obtain said objective electrophotographic photosensitive member.

The resultant electrophotographic photosensitive member was set to a conventional experimental electrophotographic copying machine to examine its electrophotographic characteristics. As a result, it was found that it excels in charge-retentivity and also in photosensitivity.

Further, the resultant electrophotographic photosensitive member was tested by subjecting it to positive charge, image exposure and toner development using said copying machine, as a result, a high quality toner image could be repeatedly obtained.

In addition, the result of subjecting the photoconductive layer to chemical composition analysis came to find that it is composed of a carbonic structural material, the neucleus of which matrix being carbon atom and which contains hydrogen atom in an amount of 15 atomic %.

EXAMPLE 10

There were prepared six kinds of sample (Sample Nos. 1 to 6) for use in measuring an electric conductivity (σd), another six kinds of sample (Sample Nos. 7 to 12) for use in measuring an optical band gap Egopt and further six kinds of sample (Sample Nos. 13 to 18) for use in measuring a Raman spectrum, respectively corresponding to the respective resultant electrophotographic photosensitive members in Examples 1 through 5 and Example 9, by repeating the respective procedures of said Examples.

The results of measuring the electric conductivity for Samples Nos. 1 to 6 were that it was less than $10^{-11}\Omega^{-1}cm^{-1}$ for very sample.

The results of measuring the optical band gap Egopt for Samples 7 to 12 were that it was more than 1.5 eV for every sample.

And, the results of measuring the Raman spectrum were that there was observed a Stokes line in such region as containing 1333 $cm^{-1}$ for every sample.

What is claimed is:

1. A photosensitive member for use in electrophotography comprising a substrate and a photoconductive layer comprising a film containing carbon atoms in an amount of at least 65 atomic percent and at least one element selected from the group consisting of boron, aluminum, gallium, indium, thallium, nitrogen, phosphorus, arsenic, antimony and bismuth in an amount of 5 atomic ppm to 5 atomic percent; said film having a matrix of said carbon atoms and said film having a value of 0.16 to 1.9 for the ratio of $I_D/I_G$ between the peak intensity ($I_D$) of 1333 $cm^{-1}$ and the peak intensity ($I_G$) of 1580 $cm^{-1}$ in Raman spectra.

2. A photosensitive member for use in electrophotography according to claim 1, wherein said value for the ratio of $I_D/I_G$ is in the range of from 1.6 to 1.9.

3. A photosensitive member for use in electrophotography according to claim 1, wherein of said at least one element in said film is unevenly distributed in the thickness direction thereof and wherein the distribution of said at least one element is concentrated adjacent said substrate.

4. A photosensitive member for use in electrophotography according to claim 1, wherein said film contains 30 atomic percent or less of hydrogen atoms.

5. A photosensitive member for use in electrophotography according to claim 1, wherein said film possesses an electric conductivity of $10^{-11}L^{-1}cm^{-1}$ or less, an optical band gap of 1.5 eV or more and contains 30 atomic present or less of hydrogen atoms.

6. A photosensitive member for use in electrophotography according to claim 1, wherein said film further possesses a gap state density of $5\times10^{17}cm^{-3}$ or less.

7. A photosensitive member for use in electrophotography according to claim 1, wherein said film further contains halogen atoms in an amount of 10 ppm to 15 atomic percent.

8. A photosensitive member for use in electrophotography according to claim 1, wherein said film has a coefficient of kinetic friction in the range of 0.5 or less.

* * * * *

UNITED STATES PATENT AND TRADEMARK OFFICE

CERTIFICATE OF CORRECTION

PATENT NO. : 4,892,800

DATED : January 9, 1990

INVENTOR(S) : MASAO SUGATA, ET AL.

It is certified that error appears in the above-identified patent and that said Letters Patent is hereby corrected as shown below:

COLUMN 1

Line 38, "a" should read --an--.

COLUMN 3

Line 61, "with " should be deleted.

COLUMN 4

Line 29, "complished" should read --accomplished--.

COLUMN 5

Line 6, "till" should read --still--.
Line 27, "Japanese Unxamined Patent" should read --Japanese Unexamined Patent--.
Line 63, "accelating" should read --accelerating--.
Line 64, "accelating" should read --accelerating--.

COLUMN 6

Line 51, "surved" should read --used--.

COLUMN 7

Line 12, "an" should read --a--.
Line 28, "of" (second occurrence) should read --or--.
Lines 55-56, "dopand" should read --dopant--.
Line 59, "type" should read --type from--.

UNITED STATES PATENT AND TRADEMARK OFFICE

CERTIFICATE OF CORRECTION

PATENT NO. : 4,892,800

DATED : January 9, 1990

INVENTOR(S) : MASAO SUGATA, ET AL.

It is certified that error appears in the above-identified patent and that said Letters Patent is hereby corrected as shown below:

COLUMN 8

Lines 39-40, "atrasient" should read --a transient--.
Line 45, "does immobilized" should read --is utilized--.

COLUMN 9

Lines 63-64, "extraporating" should read --extrapolating--.

COLUMN 10

Line 3, "extraporating" should read --extrapolating--.
Line 6, "extraporation" should read --extrapolation--.
Line 11, "extraporation" should read --extrapolation--.

COLUMN 11

Line 14, "atomic or" should read --atomic % or--.

COLUMN 12

Line 38, "comparision" should read --comparison--.

COLUMN 13

Line 11, "extraporating" should read --extrapolating--.
Line 31, "a" should read --an--.
Line 34, "a" should read --an--.

UNITED STATES PATENT AND TRADEMARK OFFICE

CERTIFICATE OF CORRECTION

PATENT NO. : 4,892,800

DATED : January 9, 1990

INVENTOR(S) : MASAO SUGATA, ET AL.

It is certified that error appears in the above-identified patent and that said Letters Patent is hereby corrected as shown below:

COLUMN 14

Line 14, "continueously" should read --continuously--.
Line 42, "accelating election" should read --accelerating electron--.
Line 43, "accelating" should read --accelerating--.
Line 60, "to" should read --to make--.
Line 61, "to generate" should be deleted.
Line 64, "surved" should read --used--.
Line 66, "vias voltage" should read --bias voltage--.

COLUMN 15

Line 1, "accelate" should read --accelerate--.
Line 8, "outobias" should read --other bias--.
Line 68, "under described" should read --described below--.

COLUMN 18

Line 5, "another" should read --other--.
Line 19, "embeded" should read --embedded--.
Line 21, "place" should read --placed--.

COLUMN 19

Line 15, "of the" should be deleted.
Line 21, "act" should read --act as--.
Line 24, "clinder was used" should read --cylinder--.

UNITED STATES PATENT AND TRADEMARK OFFICE

CERTIFICATE OF CORRECTION

PATENT NO. : 4,892,800

DATED : January 9, 1990

INVENTOR(S) : MASAO SUGATA, ET AL.

It is certified that error appears in the above-identified patent and that said Letters Patent is hereby corrected as shown below:

COLUMN 20

Line 38, "continueously" should read --continuously--.

COLUMN 21

Line 6, "ueously" should read --uously--.
Line 28, "continuted" should read --continued--.
Line 37, "stoped" should read --stopped--.
Line 38, "stoped" should read --stopped--.
Line 47, "ueously" should read --uously--.
Line 58, "always" should read --was always--.

COLUMN 23

Line 2, "continueously" should read --continuously--.
Line 15, "a" should read --an--.

COLUMN 24

Line 1, "continueously" should read --continuously--.
Line 7, "of the" should be deleted.
Line 50, "neucleus" should read --nucleus--.

COLUMN 25

Line 59, "neucleus" should read --nucleus--.
Line 67, "of the" should be deleted.

UNITED STATES PATENT AND TRADEMARK OFFICE

CERTIFICATE OF CORRECTION

PATENT NO. : 4,892,800

DATED : January 9, 1990

INVENTOR(S) : MASAO SUGATA, ET AL.

It is certified that error appears in the above-identified patent and that said Letters Patent is hereby corrected as shown below:

COLUMN 26

Line 7, "prity" should read --purity--.
Line 24, "being" should read --was--.
Line 56, "neucleus" should read --nucleus--.

COLUMN 27

Line 5, "very" should read --every--.

COLUMN 28

Line 5, "of" should be deleted.
Line 15, "$10^{-11}L^{-1}cm^{-1}$" should read --$10^{-11}\Omega^{-1}cm^{-1}$--.
Line 17, "atomic present" should read --atomic percent--.

Signed and Sealed this

Eighteenth Day of February, 1992

*Attest:*

HARRY F. MANBECK, JR.

*Attesting Officer*

*Commissioner of Patents and Trademarks*